US006936998B2

(12) United States Patent
Cho

(10) Patent No.: US 6,936,998 B2
(45) Date of Patent: Aug. 30, 2005

(54) POWER GLITCH FREE INTERNAL VOLTAGE GENERATION CIRCUIT

(75) Inventor: Sung-Hee Cho, Yongin-shi (KR)

(73) Assignee: Samsung Electronics Co., Ltd. (KR)

( * ) Notice: Subject to any disclaimer, the term of this patent is extended or adjusted under 35 U.S.C. 154(b) by 67 days.

(21) Appl. No.: 10/620,547

(22) Filed: Jul. 16, 2003

(65) Prior Publication Data

US 2004/0017183 A1 Jan. 29, 2004

(30) Foreign Application Priority Data

Jul. 26, 2002 (KR) ..... 10-2002-0044216

(51) Int. Cl.[7] ..... G05F 1/40; G05F 1/10

(52) U.S. Cl. ..... 323/280; 323/313; 327/539; 327/542

(58) Field of Search ..... 323/313, 314, 323/315, 316, 274, 276, 268, 269, 279, 280; 307/297, 304, 296.1, 29; 327/538–542

(56) References Cited

U.S. PATENT DOCUMENTS 4,442,398 A * 4/1984 Bertails et al. ..... 323/315
4,994,688 A 2/1991 Horiguchi et al. ..... 307/296.8
5,036,269 A * 7/1991 Murari et al. ..... 323/266
5,434,533 A 7/1995 Furutani ..... 327/538
5,747,974 A * 5/1998 Jeon ..... 323/269
6,020,761 A 2/2000 Hwang et al. ..... 326/80
2002/0008500 A1 1/2002 Hashimoto ..... 323/280

FOREIGN PATENT DOCUMENTS

| | | | |
|---|---|---|---|
| EP | 0 461 788 | 12/1991 | ..... G05F/1/46 |
| JP | 5-127764 | 5/1993 | ..... G05F/1/56 |
| JP | 07-234735 | 9/1995 | ..... G05F/3/24 |
| KR | 1999-31575 | 5/1999 | ..... G11C/7/00 |

* cited by examiner

*Primary Examiner*—Rajnikant B. Patel
(74) *Attorney, Agent, or Firm*—Mills & Onello LLP

(57) ABSTRACT

A power glitch free internal voltage generation circuit includes: a voltage divider for dividing level of an internal voltage; a reference voltage generator generating a reference voltage having a predetermined voltage level by dividing a level of an external voltage; a comparator connected to the external voltage and the internal voltage and comparing the divided internal voltage with the reference voltage to generate a compared output; and a driver for supplying the external voltage to the internal voltage in response to the output of the comparator. In this manner, a high voltage level from either of the external voltage and the internal voltage is used as a source of the comparator. This, in turn, stably maintains the internal voltage because the driver for transferring the external voltage to the internal voltage is intercepted in the case where a glitch occurs that lowers the external voltage to a level lower than the internal voltage.

16 Claims, 7 Drawing Sheets

POWER GLITCH FREE INTERNAL VOLTAGE GENERATION CIRCUIT

FIELD OF THE INVENTION

The present invention generally relates to a semiconductor device and, more specifically, to a power glitch free internal voltage generation circuit.

BACKGROUND OF THE INVENTION

Conventionally, to achieve low power consumption in semiconductor devices, a high voltage provided from an external source is lowered at the semiconductor circuit to generate a low internal voltage. FIG. 1 is a circuit diagram of a typical internal voltage generation circuit. Referring to FIG. 1, the internal voltage generation circuit 100 comprises a reference voltage generator 110, a comparator 120, a driver 130, a voltage divider 140 and a capacitor 150. The reference voltage generator 110, which is described in FIG. 2 in detail, divides an external voltage EXT_VDD to generate a reference voltage VREF. The comparator 120 compares the reference voltage VREF with a divided internal voltage DIV_IVC provided from the voltage divider 140 and drives the driver 130 based on results of the comparison. More specifically, the comparator 120 is supplied with the external voltage EXT_VDD. The comparator 120 is comprised of a differential amplifier as shown in FIG. 3 and compares the divided internal voltage DIV_IVC with the reference voltage VREF. The divided interval voltage DIV_IVC is generated by dividing an internal voltage IVC according to the resistance values of resistors R11, R12 of the voltage divider 140. If the divided internal voltage DIV_IVC is lower than the reference voltage VREF, the output DA_OUT of the comparator 120 has a low level. If the divided internal voltage DIV_IVC is higher than the reference voltage VREF, the output DA_OUT of the comparator 120 has a high level.

The driver 130 of FIG. 1 is composed of a PMOS transistor MP11, the bulk of which is connected to the external voltage EXT_VDD, and supplies the external voltage EXT_VDD to the internal voltage IVC in response to the output DA_OUT of the comparator 120. If the output DA_OUT of the comparator 120 has a low level, the PMOS transistor MP11 is turned on to generate the internal voltage IVC as a voltage level of the external voltage EXT_VDD. If the output DA_OUT of the comparator 120 has a high level, the PMOS transistor MP11 is turned off to prevent the external voltage EXT_VDD from being supplied to the internal voltage IVC. At this time, the level of the internal voltage IVC is maintained by the voltage level charged in the capacitor 150.

FIG. 4 shows an operation graph of the internal voltage generation circuit 100. Referring to FIG. 4, on the left side of the graph, an increasing internal voltage IVC is generated according to an increasing level of the external voltage EXT_VDD. This is because the PMOS transistor MP11 of the driver 130 is turned on in response to the output DA_OUT of the comparator 120. When the external voltage EXT_VDD becomes higher than a certain voltage level, the internal voltage IVC maintains a constant voltage. This is because the PMOS transistor MP11 of the driver 130 is turned off in response to the output DA_OUT of the comparator 120 being at a high level.

However, the internal voltage generation circuit 100 has a problem in that the voltage level of the internal voltage IVC is changed instantly in response to a glitch that is generated due to a voltage level fluctuation in the external voltage EXT_VDD. This problem is described with reference to FIGS. 5A and 5B. FIG. 5A shows the internal voltage IVC when a positive-voltage-glitch occurs in the external voltage EXT_VDD. In response, the voltage level of the internal voltage IVC maintains a stable level. However, FIG. 5B shows the internal voltage IVC when a negative-voltage-glitch in the external voltage EXT_VDD. In this example, the voltage level of the external voltage EXT_VDD becomes a voltage level (IVC-Vt), where Vt is the threshold voltage of the PMOS transistor MP11. The PMOS transistor MP11 of the driver 130 is thus turned on. The internal voltage IVC generated through the activated PMOS transistor MP11 is dropped according to the glitch of the external voltage EXT_VDD, thereby causing a temporary change of the IVC voltage level, as shown. Therefore, the semiconductor device malfunctions owing to the changed internal voltage IVC.

SUMMARY OF THE INVENTION

It is therefore a feature of the present invention to provide a power-glitch-free internal voltage generation circuit.

In one aspect, the present invention is directed to a power glitch free internal voltage generation circuit, comprising: a voltage divider for dividing level of an internal voltage; a comparator connected to an external voltage and the internal voltage and comparing the divided internal voltage with a reference voltage to generate a compared output; and a driver for supplying the external voltage to the internal voltage in response to the compared output of the comparator.

More specifically, the voltage divider comprises resistors connected between the internal voltage and ground voltage in serial. The comparator comprising: a first diode-type NMOS transistor the source of which is connected to the external voltage; a second diode-type NMOS transistor the source of which is connected to the internal voltage; a first PMOS transistor the source and bulk of which are connected drains of the first and second NMOS transistors, and the gate and drain of which are connected; a second PMOS transistor the source of which is connected to the drains of the first and second NMOS transistors, and the gate of which is connected to a gate of the first PMOS transistor; third and fourth NMOS transistors connected to drains of the first and second PMOS transistors, respectively and gated to the reference voltage and the divided internal voltage; and a fifth NMOS transistor connected between drains of the third and fourth NMOS transistors and ground voltage and gated to a signal enabling the comparator. The driver is composed Of a PMOS transistor the source of which is connected to the external voltage, the gate of which is connected to the output of the comparator, the drain of which is connected to the internal voltage, and where the drains of the first and second NMOS transistors of the comparator are connected to a back bias voltage.

Thus, according to the internal voltage generation circuit of the present invention, a higher voltage level from either of the external voltage and the internal voltage is used as power source of the comparator, thereby stably maintaining the internal voltage level, even in the case where a glitch occurs that lowers the external voltage to a level lower than the internal voltage.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

The present invention will now be described more fully hereinafter with reference to the accompanying drawings, in which exemplary embodiments of the invention are shown. This invention may, however, be embodied in different forms and should not be constructed as limited to the embodiments set forth herein. Rather, these embodiments are provided so that this disclosure will be thorough and complete, and will fully convey the scope of the invention to those skilled in the art.

Figure 1:
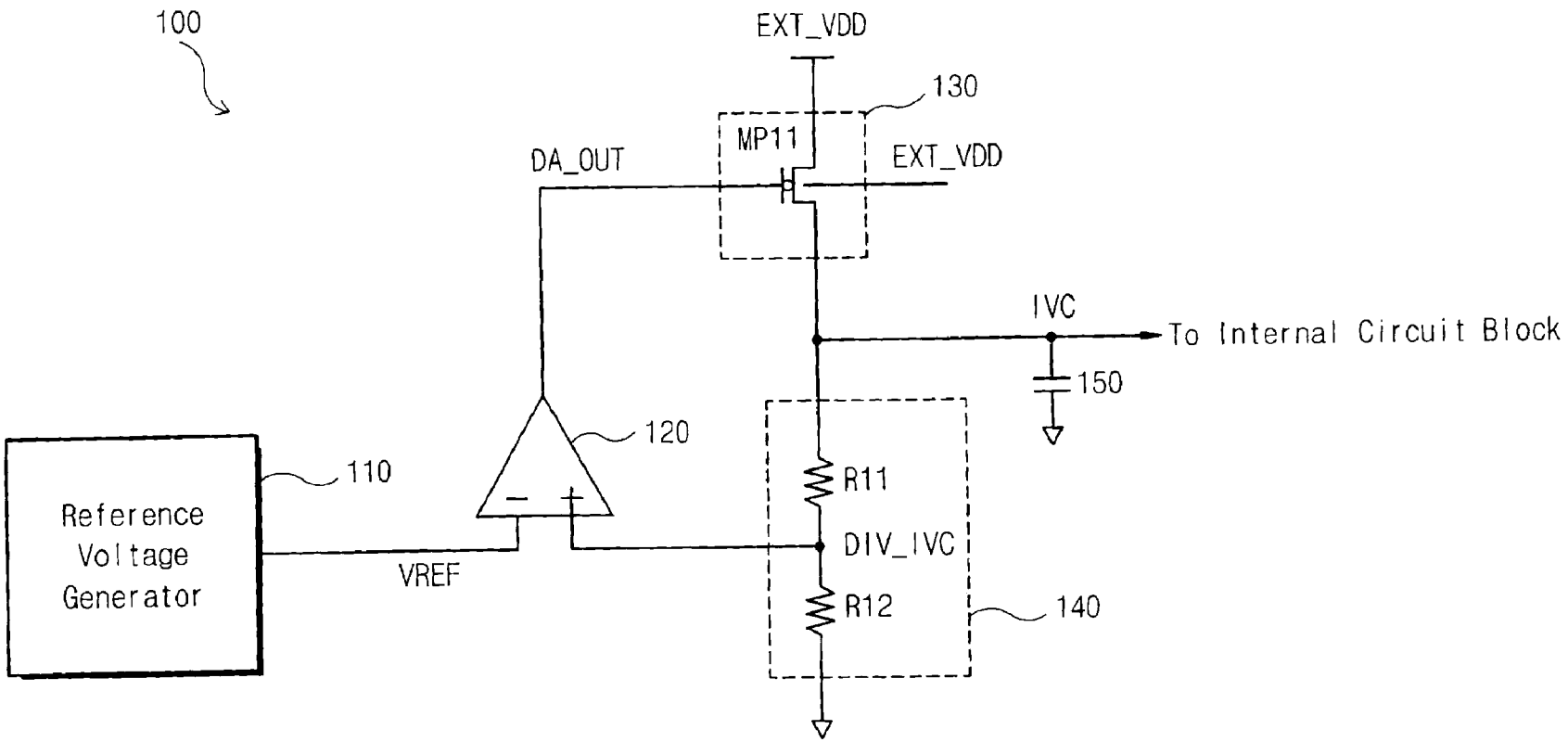
FIG. 1 is a circuit diagram illustrating a conventional internal voltage generation circuit.
Figure 2:
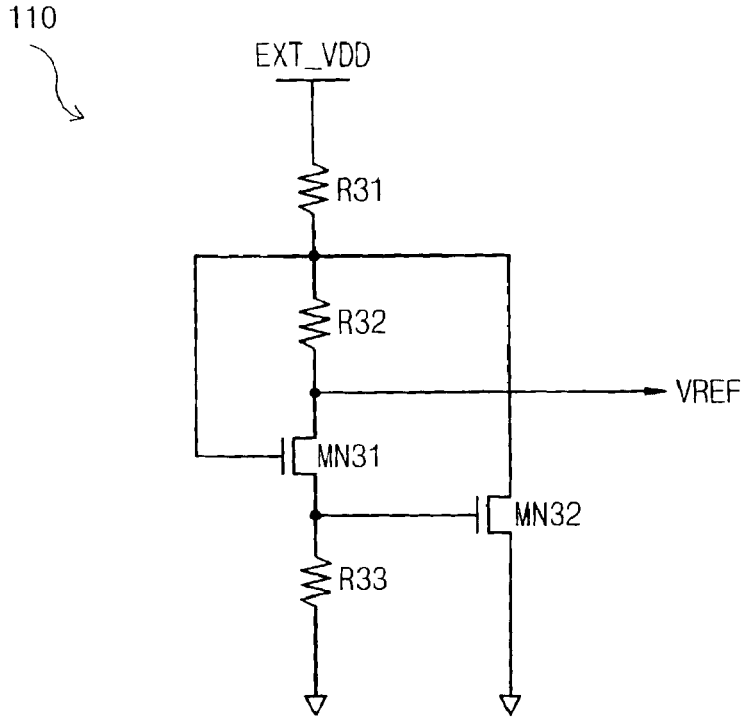
FIG. 2 is a circuit diagram illustrating the reference voltage generation circuit of FIG. 1.
Figure 3:
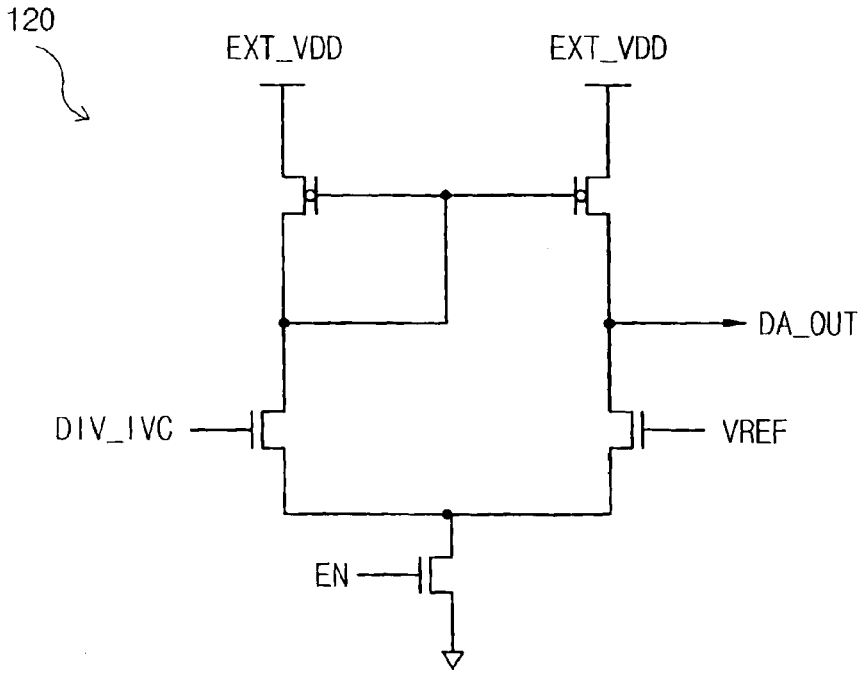
FIG. 3 is a circuit diagram illustrating the comparator of FIG. 1.
Figure 4:
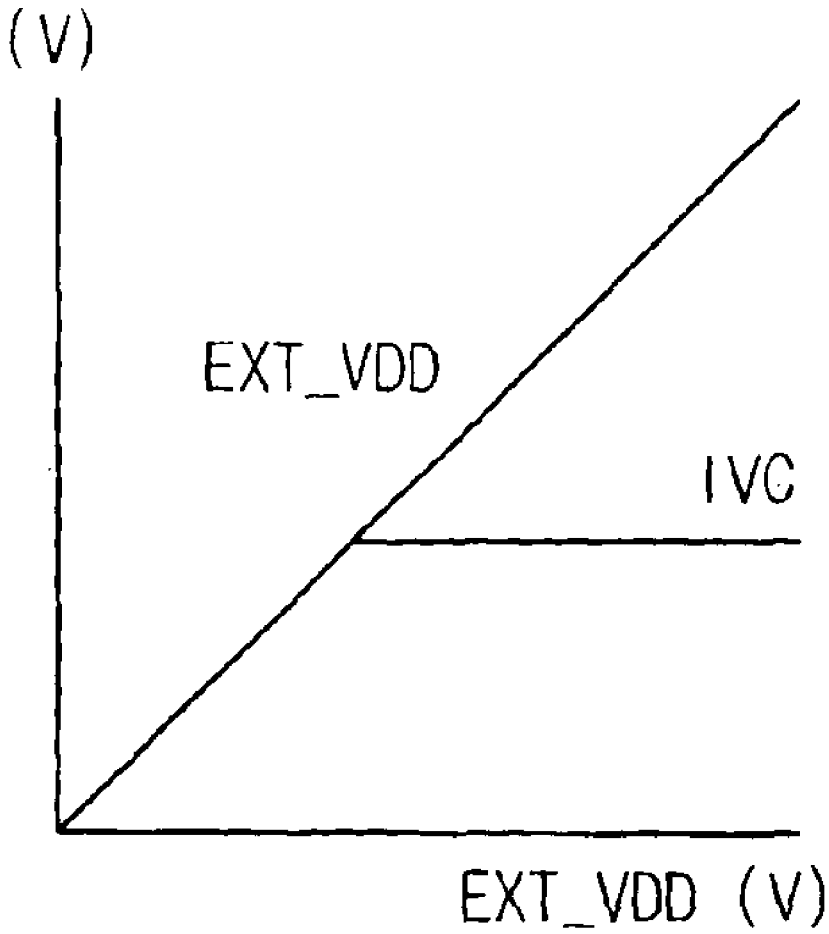
FIG. 4 is an operation graph of the internal voltage generation circuit of FIG. 1.
Figure 5A:
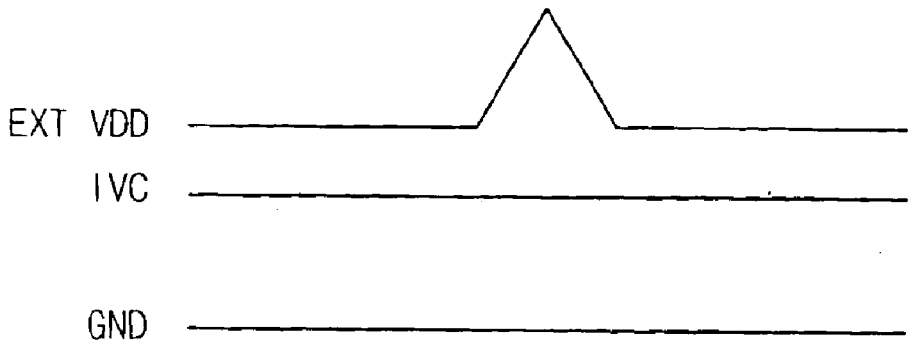
FIGS. 5A and 5B are operation waveforms of the internal voltage generation circuit of FIG. 1 when an external voltage glitch is generated.
Figure 5B:
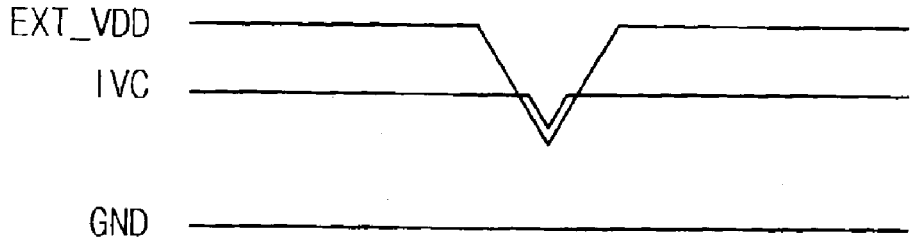
Figure 6:
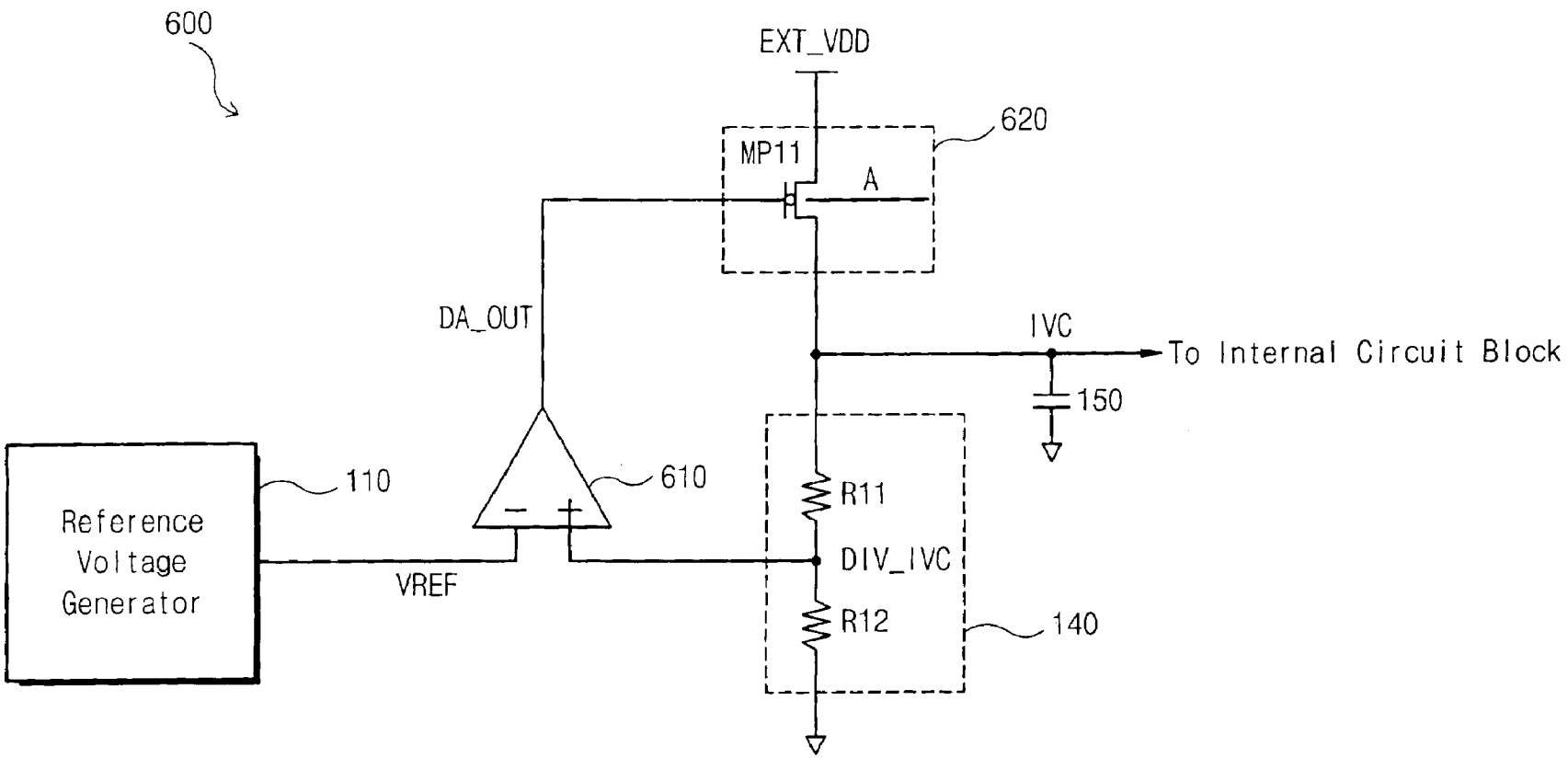
FIG. 6 is a circuit diagram illustrating an internal voltage generation circuit in accordance with an exemplary embodiment of the present invention.

FIG. 6 is a diagram illustrating an internal voltage generation circuit in accordance with an exemplary embodiment of the present invention. Referring to FIG. 6, the internal voltage generation circuit 600 utilizes a comparator, for example, the comparator 610 of FIG. 7, and a driver 620 composed of a PMOS transistor MP11 where the back bias voltage is connected to a node "A" of the comparator 610 of FIG. 7. In this manner, a stable internal voltage IVC is generated, even during the occurrence of a glitch in the external voltage EXT_VDD.

Figure 7:
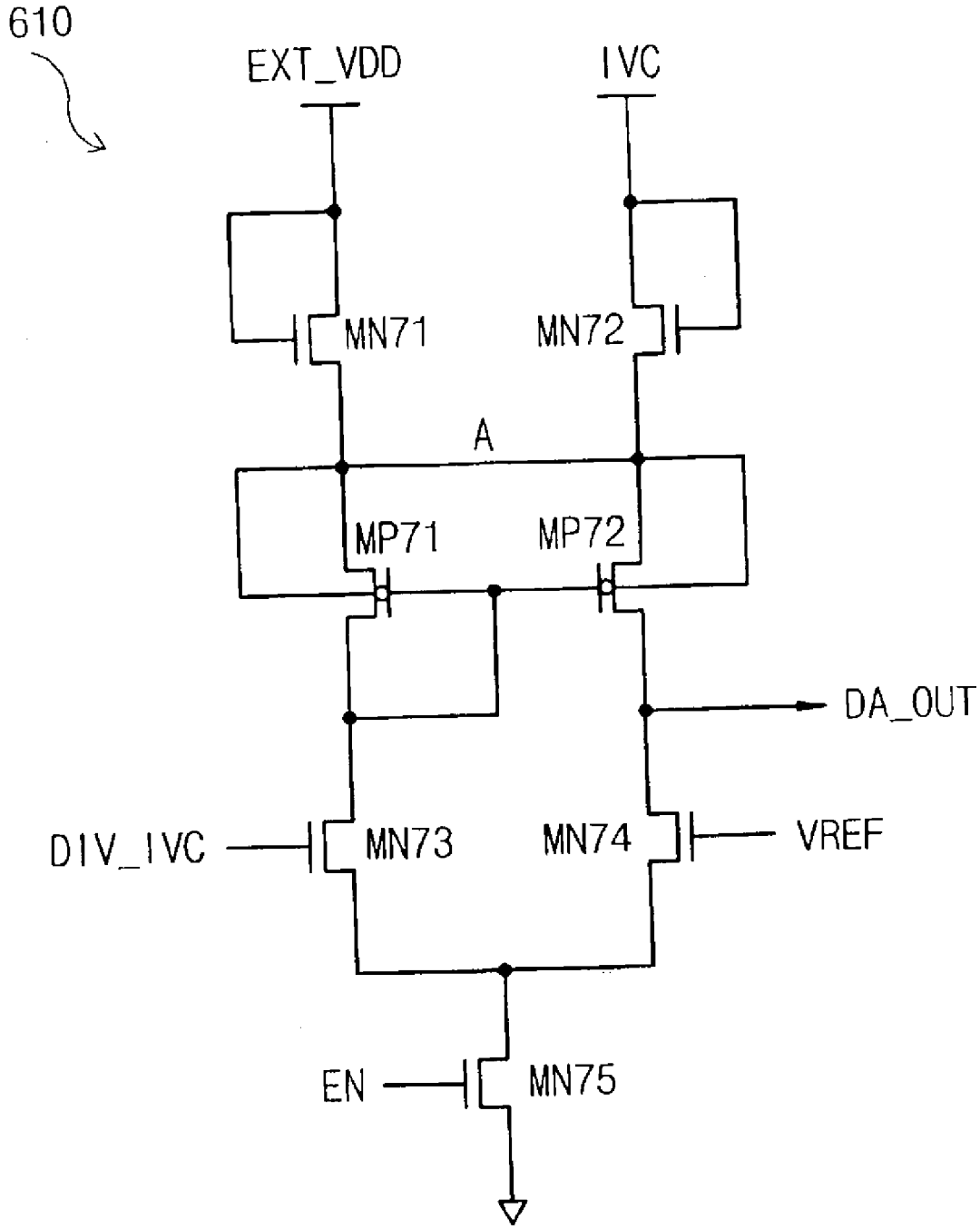
FIG. 7 is a diagram illustrating a comparator in accordance with an exemplary embodiment of the present invention.

Referring to FIG. 7, a comparator 610 includes first through fifth NMOS transistors MN71, MN72, MN73, MN74 and MN75, and first and second PMOS transistors MP71 and MP72. The first NMOS transistor MN71 is configured as a diode-type transistor, the source of which is connected to an external voltage EXT_VDD. The second NMOS transistor MN72 is also configured as a diode-type transistor, the source of which is connected to an internal voltage IVC. Drains of the first and second NMOS transistors MN71 and MN72 are connected to a node "A". The first and second NMOS transistors MN71 and MN72 utilize native transistors the threshold voltage Vth of which is near 0V. A source and a bulk of the first PMOS transistor MP71 are connected to the node "A", and a drain thereof is connected to a gate thereof. A source and a bulk of the second PMOS transistor MP72 are connected to the node "A" and a gate thereof is connected to the gate of the first PMOS transistor MP71. Sources of third and fourth NMOS transistors MN73 and MN74 are connected to the drains of the first and second PMOS transistors MP71 and MP72, respectively, and gates thereof are connected to a divided internal voltage DIV_IVC and a reference voltage VREF, respectively. The fifth NMOS transistor MN75 is connected between the drains of the third and fourth NMOS transistors MN73 and MN74, and ground voltages. The gate thereof is connected to an enable signal EN of the comparator.

The comparator 610 operates as follows. First, when the external voltage EXT_VDD is higher than the internal voltage IVC, for example, under operation in a normal state, the node "A" has the voltage level of the external voltage EXT_VDD. The comparator 610 compares the divided internal voltage DIV_IVC with the reference voltage VREF to generate an output DA_OUT. For example, if the divided internal voltage DIV_IVC is lower than the reference voltage VREF, the output DA_OUT has a low level, and if the divided internal voltage DIV_IVC is higher than the reference voltage VREF, the output DA_OUT has a high level. The external voltage EXT_VDD is supplied to the internal voltage IVC by driving the driver 620 of FIG. 7 in response to the output DA_OUT being at a low level of a ground voltage level so as to supplement the voltage level of the lowered internal voltage IVC, for example due to the driving of internal circuit blocks. The output DA_OUT being at the high level of the external voltage EXT_VDD turns off the PMOS transistor MP11 of the driver 130, so that the internal voltage IVC maintains its previous level. In this manner, the level of the internal voltage IVC maintains a constant level.

Figure 8A:
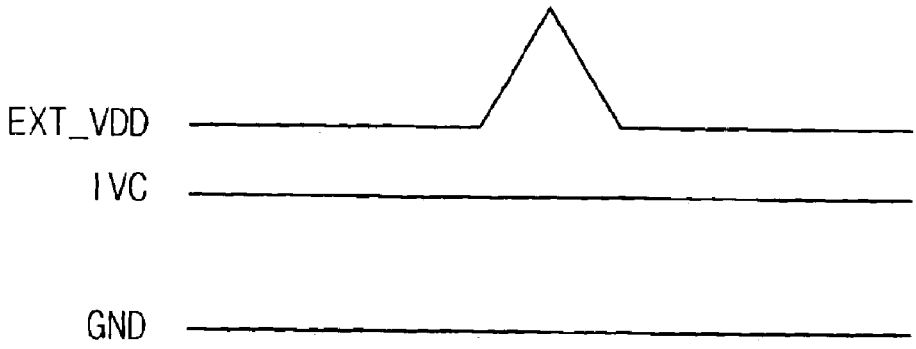
FIGS. 8A and 8B are operation waveforms of the internal voltage generation circuit of FIG. 6 when an external voltage glitch is generated.

Next, operation under abnormal states will be described. First, if a glitch having a voltage level higher than the normal voltage occurs in the external voltage EXT_VDD, the external voltage operates in the same state as the normal state. As shown in FIG. 8A, the internal voltage IVC is stably generated in response to the output DA_OUT of the comparator 610.

Figure 8B:
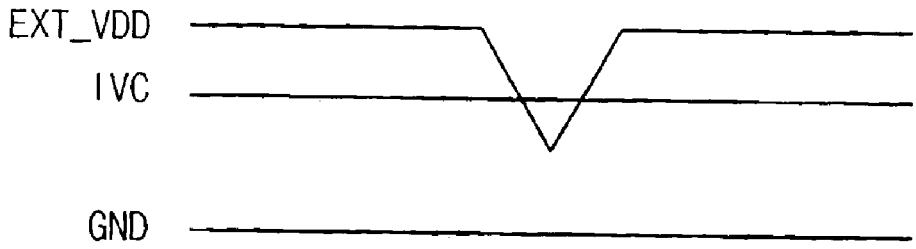

Second, if a glitch having a voltage level lower than the internal voltage IVC occurs in the external voltage EXT_VDD, the voltage level of node "A" becomes the level of the internal voltage IVC. If the voltage level of the output DA_OUT of the comparator 610 becomes high at the level of the internal voltage IVC, the internal voltage IVC is thus connected to a gate of the PMOS transistor MP11 of the driver 30, the external voltage EXT_VDD with a voltage level lower than the internal voltage IVC is connected to the source of transistor MP11, and the drain of MP11 is connected to the internal voltage IVC, thereby turning off the PMOS transistor MP11. Therefore, the internal voltage maintains a stable level under these circumstances, because the glitch generated in the external voltage EXT_VDD is not transmitted to the internal voltage IVC, even though the glitch has a voltage level lower than the internal voltage IVC. The resulting waveform is shown in FIG. 8B.

On the other hand, the voltage level of the output DA_OUT of the comparator 610 does not become a ground voltage level. This is because the internal voltage IVC is higher than the external voltage EXT_VDD, so that the divided internal voltage DIV_IVC may not become lower than the reference voltage VREF. As a result, the output DA_OUT of the comparator 610 does not have a low level.

According to the internal voltage generation circuit of the present invention, a glitch that occurs when the external voltage EXT_VDD is lowered to a level that is lower than the internal voltage IVC is not transferred to the internal voltage IVC, so that the internal voltage maintain a stable voltage level. The internal voltage generation circuit utilizes the higher level of the external and internal voltages as a source of the comparator. Therefore, even in the case where a glitch occurs when the external voltage becomes lower than the internal voltage, the driver transmitting the external voltage to the internal voltage is cut off, so that the internal voltage is maintained at a stable level.

While this invention has been particularly shown and described with references to preferred embodiments thereof, it will be understood by those skilled in the art that various changes in form and details may be made herein without departing from the spirit and scope of the invention as defined by the appended claims.

What is claimed is:

1. An internal voltage generation circuit, comprising:

a voltage divider for dividing a level of an internal voltage to provide a divided internal voltage;

a comparator connected to an external voltage and the internal voltage, for comparing the divided internal voltage with a reference voltage to generate a compared output; and a driver connected to the external voltage for supplying the external voltage to the internal voltage in response to the compared output of the comparator, wherein when the external voltage is reduced to a level that is lower than the internal voltage, the compared output inactivates the driver, and the driver prevents the supplying of the reduced external voltage to the internal voltage and the internal voltage maintains a constant level.

2. The internal voltage generation circuit of claim 1, wherein the voltage divider comprises resistors serially connected between the internal voltage and ground voltage.

3. The internal voltage generation circuit of claim 1, wherein the internal voltage generation circuit further comprises a reference voltage generator for generating the reference voltage having a predetermined voltage level by dividing a level of the external voltage.

4. The internal voltage generation circuit of claim 1, wherein, the comparator comprises:

a first diode-type NMOS transistor the source of which is connected to the external voltage;

a second diode-type NMOS transistor the source of which is connected to the internal voltage;

a first PMOS transistor the source and bulk of which are connected to drains of the first and second NMOS transistors, and the gate and drain of which are connected to each other;

a second PMOS transistor the source and bulk of which are connected to the drains of the first and second NMOS transistors, and the gate of which is connected to a gate of the first PMOS transistor;

third and fourth NMOS transistors connected to drains of the first and second PMQS transistors and gated to the reference voltage and the divided internal voltage, respectively; and a fifth NMOS transistor connected between drains of the third and fourth transistors and ground voltage and gated to a signal enabling the comparator.

5. The internal voltage generation circuit of claim 4, wherein the driver is a PMOS transistor the source of which is connected to the external voltage, the gate of which is connected to the output of the comparator, the drain of which is connected to the internal voltage, and where the drains of the first and second NMOS transistors of the comparator are connected to a back bias voltage of the PMOS transistor of the driver.

6. The internal voltage generation circuit of claim 4, wherein the first and second NMOS transistors are native transistors the threshold voltages of which are 0V.

7. The internal voltage generation circuit of claim 4, wherein the compared output of the comparator is provided at the drain of the second PMOS transistor.

8. An internal voltage generation circuit, comprising:

a voltage divider for dividing a level of an internal voltage to provide a divided internal voltage;

a comparator connected to an external voltage and the internal voltage, for comparing the divided internal voltage with a reference voltage to generate a compared output; and a driver connected to the external voltage for supplying the external voltage to the internal voltage in response to the compared output of the comparator, wherein the driver comprises a transistor having a back-bias voltage connected to an internal node of the comparator.

9. The internal voltage generation circuit of claim 8, wherein the voltage divider comprises resistors serially connected between the internal voltage and ground voltage.

10. The internal voltage generation circuit of claim 8, wherein the internal voltage generation circuit further comprises a reference voltage generator for generating the reference voltage having a predetermined voltage level by dividing a level of the external voltage.

11. The internal voltage generation circuit of claim 8, wherein the comparator comprises:

a first diode-type NMOS transistor the source of which is connected to the external voltage;

a second diode-type NMOS transistor the source of which is connected to the internal voltage;

a first PMOS transistor the source and bulk of which are connected to drains of the first and second NMOS transistors at the internal node, and the gate and drain of which are connected to each other;

a second PMOS transistor the source and bulk of which are connected to the drains of the first and second NMOS transistors at the internal node, and the gate of which is connected to a gate of the first PMOS transistor;

third and fourth NMOS transistors connected to drains of the first and second PMOS transistors and gated to the reference voltage and the divided internal voltage, respectively; and a fifth NMOS transistor connected between drains of the third and fourth transistors and ground voltage and gated to a signal enabling the comparator.

12. The internal voltage generation circuit of claim 11, wherein the driver is a PMOS transistor the source of which is connected to the external voltage, the gate of which is connected to the output of the comparator, the drain of which is connected to the internal voltage, and where the drains of the first and second NMOS transistors of the comparator are connected to a back bias voltage of the transistor of the driver.

13. The internal voltage generation circuit of claim 11, wherein the first and second NMOS transistors are native transistors the threshold voltages of which are 0V.

14. The internal voltage generation circuit of claim 11, wherein the compared output is provided at the drain of the second PMOS transistor.

15. The internal voltage generation circuit of claim 8, wherein the internal node comprises a common node of the comparator between a first terminal of a first transistor configured as a diode-type transistor, a second terminal of the first transistor being connected to the external voltage, and a first terminal of a second transistor configured as a diode-type transistor, a second terminal of the second transistor being connected to the internal voltage.

16. The internal voltage generation circuit of claim 15, wherein the first transistor comprises an NMOS transistor having a gate and source of which are coupled to the external voltage, and having a drain of which is coupled to the common node, and wherein the second transistor comprises an NMOS transistor having a gate and source of which are coupled to the internal voltage, and having a drain of which is coupled to the common node.

* * * * *

UNITED STATES PATENT AND TRADEMARK OFFICE

CERTIFICATE OF CORRECTION

PATENT NO. : 6,936,998 B2
DATED : August 30, 2005
INVENTOR(S) : Sung-Hee Cho

It is certified that error appears in the above-identified patent and that said Letters Patent is hereby corrected as shown below:

Column 5,
Line 42, delete the "," after "wherein".
Line 57, delete "PMQS" and insert -- PMOS --.

Signed and Sealed this

Thirteenth Day of December, 2005

JON W. DUDAS
*Director of the United States Patent and Trademark Office*